US005512201A

United States Patent [19]

Singh et al.

[11] Patent Number: 5,512,201

[45] Date of Patent: Apr. 30, 1996

[54] SOLDER AND TIN STRIPPER COMPOSITION

[75] Inventors: Rajwant Singh, Fullerton, Calif.; Nenad Mandich, Homewood, Ill.; Gerald A. Krulik, San Clemente, Calif.

[73] Assignee: Applied Chemical Technologies, Inc., Santa Ana, Calif.

[21] Appl. No.: 388,444

[22] Filed: Feb. 13, 1995

[51] Int. Cl.[6] ..... C23D 1/00

[52] U.S. Cl. ..... 252/142; 252/79.2; 252/79.3; 252/79.4; 252/147; 252/148; 252/151; 252/146; 252/DIG. 8

[58] Field of Search ..... 252/79.2, 79.3, 252/79.4, 142, 147, 148, 151, DIG. 8, 146

[56] References Cited

U.S. PATENT DOCUMENTS

| | | | |
|---|---|---|---|
| 2,829,107 | 4/1958 | Ruff et al. | 252/137 |
| 2,975,039 | 3/1961 | Elliott | 41/42 |
| 3,926,699 | 12/1975 | Dixon | 156/3 |
| 3,990,982 | 11/1976 | Dixon | 252/79.3 |
| 4,410,396 | 10/1983 | Somers et al. | 156/664 |
| 4,678,541 | 7/1987 | Tytgat et al. | 156/664 |
| 4,713,144 | 12/1987 | Schiller | 156/656 |
| 4,728,456 | 3/1988 | Yamasoe et al. | 252/142 |
| 4,851,148 | 7/1989 | Yamasoe et al. | 252/142 |
| 4,886,616 | 12/1989 | Yamasoe et al. | 252/142 |
| 4,921,571 | 5/1990 | Kukanskis et al. | 156/656 |
| 4,957,653 | 9/1990 | Cordani | 252/142 |
| 4,964,920 | 10/1990 | Jackson et al. | 134/3 |
| 5,035,749 | 7/1991 | Haruta et al. | 134/2 |
| 5,219,484 | 6/1993 | Krulik | 252/79.2 |
| 5,234,542 | 8/1993 | Cordani | 156/656 |
| 5,244,539 | 9/1993 | McGrath et al. | 156/656 |

*Primary Examiner*—Paul Lieberman
*Assistant Examiner*—Wyatt B. Pratt

[57] ABSTRACT

A metal dissolving liquid and method for stripping tin and solder coatings, including the underlying tin-copper alloy, from the copper substrate of a printed circuit board. The liquid includes an aqueous solution of nitric acid in an amount sufficient to dissolve solder and tin, a source of ferric ions in an amount sufficient to dissolve tin-copper alloy, a source of halide ions in an amount sufficient to solubilize tin, an effective amount of methylsulfonic acid as promoter for complete stripping, and a source of an organic, water soluble amine. The combination of ingredients will substantially eliminate sludge formation, reduce attack on the copper substrate and provide a bright copper finish after solder removal. A liquid further including organic triazoles including benzotriazole in amounts not more than about 5% by weight and sulfamic ions in amounts not more than about 2.5% by weight.

5 Claims, No Drawings

SOLDER AND TIN STRIPPER COMPOSITION

BACKGROUND OF THE INVENTION

This invention relates to the removal of solder and tin films from printed circuit boards and to a new and improved method and composition for stripping the solder and tin films and the underlying tin-copper alloy from the copper substrate of a printed circuit board in a single application of the composition as by spraying or dipping.

A typical printed circuit board uses a copper conductor attached to an insulating support, in a patterned manner. Solder is applied onto the copper substrate, typically by electroplating before the copper conductor becomes patterned into the final electrical circuit. The solder film is nominally 0.0003 inches thick which is the standard thickness used in most current day processes. When tin is used, the thickness is approximately three times greater, but the process is the same. The actual thickness may vary considerably over the board and from board to board, as in any manufacturing process. Once tin or solder is applied to the copper, a thin film of copper-tin alloy forms by solid state diffusion between the copper and solder. This copper-tin alloy film increases in thickness with time, but is typically about 0.000002 to 0.000004 inches thick.

As used in the specification and claims, the word "solder" includes the various low melting point alloys and elements used for electrical soldered connections and for copper etching masks or resists. The majority of such coatings are of various compositions of tin-lead alloys, or are substantially pure tin, but can also include lead-free alloys, pure lead coatings, and alloys containing silver, bismuth, cadmium, indium, and other metals. Such films are produced by various methods, including electroplating, chemical deposition and immersion in a melt. Some of these metals, but especially tin, can be difficult to strip effectively due to the formation of passivating films. Thus tin strips easily, if slowly, in dilute acidic stripping solutions, but may form a largely insoluble film in concentrated stripping solutions.

When applied as a bulk film, the solder may be used as a resist over the copper during etching of the copper in the production of solder mask over bare copper boards. During the manufacturing process the solder film is applied in an image-wise fashion to those areas which will be the final copper conductor. The uncoated copper is then etched from the insulating and supporting base by means of selective chemical etchants for the copper, such as ammoniacal cupric chloride solution. The solder film is later stripped from the copper substrate to allow for final fabrication, assembly, and testing. In other applications, solder is used to join two or more electrical conductors together. This solder may be removed by solder strippers for more effective rework, during salvage of board components, and during treatment of scrap and recycle boards to remove lead to reduce environmental liabilities.

Two types of compositions have been generally used in the past for solder stripping. The most widely used prior compositions were based on mixtures of an acidic solution of hydrogen peroxide and fluoride. In recent years formulations based on nitric acid solution containing ferric ion have become widely commercially used.

Acidic peroxide solutions break down during both use and storage. The stripping reaction is exothermic, thus the solution temperature increases which decomposes and wastes the unstable peroxide, while increasing both the solder etch rate and the copper etch rate. The solution requires strict control of the amount of throughput, and/or cooling during use to eliminate these problems. The fluoride content of the solutions leads to rapid attack of the fiberglass used as a component of the insulating substrate. Fluoride is both extremely toxic to the operators and difficult to effectively waste treat.

Nitric acid based solutions eliminate most of these problems. The earliest nitric acid strippers were two solution systems, consisting of a nitric acid solution to dissolve the solder, followed by a second acidic solution containing ferric ions or other materials to remove the tin-copper alloy. The second solution may contain ferric chloride, ammonium persulfate, a mixture of hydrogen peroxide and sulfuric acid, or a conventional acidic hydrogen peroxide-fluoride mixture.

The composition of U.S. Pat. No. 4,713,144 utilizes a combination of nitric, ferric and sulfamic acid which strips quickly but generates a large amount of tin rich sludge. Formulations containing organic acids such as U.S. Pat. No. 5,219,484 have been used to attempt to solve the sludge problem but were not satisfactory in that they only delayed the formation of sludge.

The composition of U.S. Pat. No. 5,244,539 utilizes a combination of nitric, ferric, and ammonium ions in combination with urea as a nitric acid fume suppressant and organic triazoles as copper anti-tarnish agents. This gives a low sludging solution but the urea reacts with nitric acid to give the heat-sensitive explosive urea nitrate which precipitates from the solution.

The basic composition and method for single bath and spray stripping is now well described in prior art patents. Commercialization of this process is dependent on meeting most of the following customer expectations: complete stripping in a reasonable minimum time, low attack rate on the exposed copper, a bright surface on the exposed copper which does not rapidly tarnish, long solution stripping life, little toxic fume evolution, and little or no sludge formation. It is an object of the present invention to provide a new and improved composition and method for solder stripping which provides fast, complete stripping without formation of a passive solder surface, with a resulting bright copper surface which tarnishes slowly, and with minimal solution fuming and sludge formation, using a single process solution.

These and other objects, advantages, features and results will more fully appear in the course of the following description.

SUMMARY OF THE INVENTION

The invention comprises a metal dissolving liquid and method for stripping tin and solder coatings, including any underlying tin-copper alloy, from the copper substrate of a printed circuit board. The liquid consists of an aqueous solution of nitric acid in an amount sufficient to dissolve solder and tin, a source of ferric ions in an amount sufficient to dissolve tin-copper alloy, a source of halide ions in an amount sufficient to solubilize tin, an effective amount of methylsulfonic acid as promoter for complete stripping, and a source of an organic, water soluble amine to provide extra copper brightness, lessened sludge formation, and a more stable, extended solder stripping rate.

It is a particularly novel and unexpected feature of the invention to use a combination of halide ions and water soluble organic amine in the stripping solution for sludge reduction without decreasing the copper brightness or increasing the rate of copper attack.

The liquid further includes a material selected from the group consisting of benzotriazole, carboxybenzotriazole, tolytriazole and their salts, and combinations thereof in an amount not more than about 2% by weight of the liquid, and sulfamic ion, as the acid or a salt, in an amount not more than about 2% by weight of the liquid. The triazole corrosion inhibitors will reduce help to reduce attack on the copper substrate during stripping, but their main function is to provide a bright copper finish with extended storage life without tarnishing after solder removal. The sulfamic ions function to suppress the evolution of toxic nitric oxide fumes during storage of the liquid and especially during use of the liquid for stripping.

More specifically the liquid includes an aqueous solution of about 20 to 50 weight percent of nitric acid (70%), about 1 to 25 weight percent of a ferric ion source equivalent to 45 weight percent ferric nitrate solution, about 0.5 to 10 weight percent of chloride ion, about 0.25 to 7.5 weight percent of methylsulfonic acid, and about 0.1 to 5 weight percent of a water soluble organic amine. The liquid further includes an organic triazole compound used for corrosion inhibition of the exposed copper, such as benzotrazole, carboxybenzotriazole, and tolytriazole and their salts, in an amount of about 0.1 to 5 weight percent, and a sulfamate in the form of an acid or salt, in an amount of about 0.05 to 2.5 weight percent.

A method comprises providing such a liquid and applying it to a printed circuit board, preferably by spraying directly onto the board.

DESCRIPTION OF THE PREFERRED EMBODIMENTS

The basic composition of the invention is a liquid containing an aqueous solution of nitric acid; a source of ferric ions, typically ferric nitrate; a source of chloride ions, typically from hydrochloric acid; a source of methylsulfonic acid, typically an aqueous solution; and a source of a water soluble organic amine, typically reacted with some or all of the necessary hydrochloric acid to form a chloride salt. The combination of these constituents in the ranges described produce the desired solder stripper which completely strips to the underlying copper in an economically practical time, without significant attack on the underlying copper, and without production of a significant amount of sludge. The liquid may further contain an effective amount of triazole corrosion inhibitors for long term storage without tarnishing, and an effective amount of a nitrogen oxide fume inhibitor such as sulfamic acid.

While not wishing to be bound by theory, the following is considered to be a brief summary of the processes occurring during stripping of solder such as 60:40 weight per cent tin:lead solder. During operation of the stripper, the nitric acid functions to dissolve the solder and tin by a oxidizing the lead and tin of the solder, and forming water soluble nitrate salts. Ferric ions such as from ferric nitrate are an effective oxidizing agent for many metals and additionally help to dissolve the solder, while becoming reduced to inactive ferrous ions. "Spent" solder strippers can be to some extent reactivated by allowing the ferrous ions to reoxidize back to ferric ions, by exposure to air, oxygen, or hydrogen peroxide. High concentrations of nitric acid can passivate metals such as tin by a poorly understood process involving formation of an insoluble oxide layer. Chloride ions help to dissolve the tin by forming soluble tin chloride salts, but too much chloride can give an insoluble oxychloride surface layer on the tin. Methylsulfonic acid seems to function to counteract the inhibitory effects of high concentrations of nitric acid and chloride by reacting readily with and dissolving these insoluble surface films. Only a relatively small amount of methlysulfonic acid is necessary to overcome these inhibitory effects, thus allowing formulation of liquid strippers with greater amounts of nitric acid and chloride ion, and giving faster stripping and longer bath life.

Some of the tin of the solder reacts to form an alloy with the underlying copper, which is less easily dissolved than either tin, lead, or their mixture. The ferric ions function as a stronger oxidizing agent than nitric acid to dissolve this tin-copper alloy and to expose the pure copper of the film. The water soluble organic amine functions to improve the uniformity of stripping of the solder from the copper to give improved brightness of the underlying copper, and to help solubilize the tin to prevent sludge formation, perhaps by preventing formation of very insoluble metastannic acid.

A large range of variation of each of these components is possible while still achieving the desired results. The tests set out in the Table below typify some of the compositions and ranges which will produce an acceptable stripping composition.

The stripping of the solder from the boards is done either by a dip tank or by transport by a conveyor system through a spray booth. Both such systems are in such common use as to need little further explanation. Insoluble sludges containing much of the tin must be periodically removed as they accumulate, but obviously will cause more problems with a spray nozzle system than with a dip tank. This sludge must be removed and the tanks cleaned following shut down of operations and settling of the sludge. This reduces the production rate and increases production costs. The compositions of the present invention reduce or eliminate such sludge accumulation, allowing for more efficient and less costly operation. Sulfamic acid, due to its relatively low water solubility, is most conveniently added as the solid acid although any effective salt such as ammonium sulfamate may be used.

Nitric acid is commercially available as a wide range of compositions, but commonly as a nominally 70% by weight solution. Methylsulfonic acid is also commercially available as a nominal 70% by weight solution. Ferric nitrate is most economically available as an aqueous solution containing 45% by weight of anhydrous ferric nitrate. Other effective soluble ferric salts or ferric solutions may be substituted for the ferric nitrate within the limits of the formulation.

Chloride ions may be obtained from ferric chloride, hydrochloric acid, ammonium chloride, or as the chloride salt of a water soluble organic amine. Most water soluble organic amines are highly alkaline and may react in a vigorous manner if added rapidly to a solution of acids and ferric salts. It is most convenient to partially or completely neutralize the organic amine with hydrochloric acid and add the product safely to the remainder of the mixture.

Many types of triazole compounds are commercially utilized as soluble copper corrosion inhibitors and brighteners. Any acid soluble compound or suitable salt may be used, alone or in combination. Typical triazoles include benzotriazole, tolyltriazole, and carboxybenzotriazole.

It will be recognized by those skilled in the art that many combinations of chemicals and different forms of chemicals, such as anhydrous salts, may be used to give identical aqueous solutions. Further, the ranges of chemical concentrations may be separately adjusted within these ranges to give many effective liquid compositions.

The preferred ranges of the five functional components of the stripper are about:

Nitric acid, as about 20–50 weight percent of 70% by weight aqueous solution.

Ferric ion, as about 0.1–2.6 weight percent. This is equivalent to 1–25 weight percent of 45% by weight aqueous solution of ferric nitrate, when ferric nitrate is used as the sole source of ferric ions.

Chloride ion, as about 0.5 to 10 weight percent, from hydrochloric acid, an amine chloride salt, or other source.

Methylsulfonic acid, as about 0.25 to 7.5 weight percent of 70 weight percent aqueous solution.

Water soluble organic amine, as about 0.1 to 5 weight percent, based on the free amine. To be added as either the free amine or as a chloride or other salt.

The most preferred ranges are about:

Nitric acid, as 25–40 weight percent of 70% by weight aqueous solution.

Ferric ion, as about 1–2 weight percent. This is equivalent to about 10–20 weight percent of 45% by weight aqueous solution of ferric nitrate, when ferric nitrate is used as the sole source of ferric ions.

Chloride ion, as about 0.5 to 5 weight percent, from hydrochloric acid, an amine chloride salt, or other source.

Methylsulfonic acid, as about 1 to 5 weight percent of 70 weight percent aqueous solution.

Water soluble organic amine, as about 0.25 to 5 weight percent, based on the free amine. To be added as either the free amine or as a chloride or other salt.

The preferred liquid also includes an organic triazole compound used for corrosion inhibition of the exposed copper, such as benzotriazole, carboxybenzotriazole, and tolytriazole and their salts, in an amount of about 0.1 to 5 weight percent, and a sulfamate in the form of the acid or salt, in an amount of about 0.05 to 2.5 weight percent.

Tests were conducted by immersing samples of solder plated and tin plated copper clad printed circuit boards in various test solutions. The nominal solder thickness was 0.0003 inches and the nominal composition was 60:40 weight percent tin:lead. Tin panels were identical except that the tin coating was about 0.001 inches thick. Test panels were 2.54×3.8 cm, coated on one side only.

The stripping effectiveness was determined by measuring the time needed to strip each panel immersed in a 100 ml portion of the stripping solution at room temperature without agitation. The weight of copper etched was analyzed by atomic absorption spectroscopy. The copper appearance was noted after rinsing, by evaluating both the shininess and the amount of water beading on the surface. A large amount of water beading correlated with good copper corrosion inhibition and is highly desirable.

The basic formula for the Examples consisted of the following and was used for all tests except as noted:

| BASIC FORMULA | |
|---|---|
| Deionized water | Balance |
| Nitric acid, 70% | 410 g/l |
| Ferric nitrate, 45% | 150 g/l |
| Methylsulfonic acid, 70% | 25 g/l |

-continued

| BASIC FORMULA | |
|---|---|
| Deionized water | Balance |
| Benzotriazole | 10 g/l |
| Tolyltriazole | 15 g/l |
| Amine-HCl salt | 200 g/l of 10% by weight solution |

EXAMPLES I–III

The amine was ethylenediamine, 10% by weight solution, neutralized with 80 g/l hydrochloric acid. Three levels of sulfamic acid were tested, 0, 2.5, and 5 g/l. Note that gassing or evolution of nitrogen oxides, was seen in most cases with no sulfamic acid so it is only explicitly mentioned in this first series of examples. Tin stripped slower than solder in almost every case. Since the results otherwise are very similar for both sets of test panels, only the solder results are reported here.

| ETHYLENEDIAMINE | | | | |
|---|---|---|---|---|
| EXAMPLE | SULFAMIC ACID, GRAMS | STRIP TIME, SECONDS | COPPER ETCHED, MILLIGRAMS | APPEARANCE |
| I | 0 | 90 | 48.4 | slight beading; gassing |
| II | 2.5 | 160 | 4.8 | very slight beading |
| III | 5 | 165 | 6.7 | slight beading |

EXAMPLES IV–VI

The amine was monoethanolamine, 10% by weight solution, neutralized with 80 g/l hydrochloric acid. Three levels of sulfamic acid were tested, 0, 2.5, and 5 g/l.

| MONOETHANOLAMINE | | | | |
|---|---|---|---|---|
| EXAMPLE | SULFAMIC ACID, GRAMS | STRIP TIME, SECONDS | COPPER ETCHED, MILLIGRAMS | APPEARANCE |
| IV | 0 | 165 | 48.1 | good beading |
| V | 2.5 | 165 | 6.6 | good beading |
| VI | 5 | 165 | 5.0 | fair beading |

EXAMPLES VII–IX

The amine was triethanolamine, 10% by weight solution, neutralized with 80 g/l hydrochloric acid. Three levels of sulfamic acid were tested, 0, 2.5, and 5 g/l.

| TRIETHANOLAMINE | | | | |
|---|---|---|---|---|
| EXAMPLE | SULFAMIC ACID, GRAMS | STRIP TIME, SECONDS | COPPER ETCHED, MILLIGRAMS | APPEARANCE |
| VII | 0 | 105 | 61.4 | excellent beading |
| VIII | 2.5 | 150 | 5.0 | excellent |

-continued

| TRIETHANOLAMINE | | | | |
|---|---|---|---|---|
| EXAMPLE | SULFAMIC ACID, GRAMS | STRIP TIME, SEC-ONDS | COPPER ETCHED, MILLI-GRAMS | APPEAR-ANCE |
| IX | 5 | 150 | 4.9 | beading excellent beading |

EXAMPLES X–XII

The amine was 1,1',1",1'" tetrakishydroxyethylenediamine, commonly known as Quadrol® or Mazeen® 174, 10% by weight solution, neutralized with 80 g/l hydrochloric acid. Three levels of sulfamic acid were tested, 0, 2.5, and 5 g/l.

| 1,1',1",1'" TETRAKISHYDROXYETHYLENEDIAMINE | | | | |
|---|---|---|---|---|
| EXAMPLE | SULFAMIC ACID, GRAMS | STRIP TIME, SEC-ONDS | COPPER ETCHED, MILLI-GRAMS | APPEAR-ANCE |
| X | 0 | 90 | 108.0 | no beading |
| XI | 2.5 | 165 | 5.6 | fair beading |
| XII | 5 | 165 | 5.1 | fair beading |

EXAMPLE XIII

The amine was triethanolamine, 10% by weight solution, neutralized with 80 g/l nitric acid. Two levels of sulfamic acid were tested, 0 and 5 g/l. The purpose of this test was to evaluate the necessity for chloride with the use of the organic amine. The strip time was fast but the appearance was very poor. There was no beading of water.

EXAMPLE XIV

The amine was triethanolamine, 50% by weight solution, neutralized with 400 g/l hydrochloric acid. The amount of amine solution was doubled to 400 g/l; the actual amount of amine was 10 times that of Examples VII–IX, with a corresponding decrease in the amount of water. Three levels of sulfamic acid were tested, 0, 2.5, and 5 g/l. The strip time was extremely fast but there was much gassing and fuming. The appearance was very poor with black spots and stains, and incomplete removal.

EXAMPLE XV

The amine was triethanolamine, 50% by weight solution, neutralized with 400 g/l hydrochloric acid. The amount of amine solution was kept at 200 g/l; the actual amount of amine was 5 times that of Examples VII–IX, and half that of example XIV, with a corresponding changes in the amount of water. Three levels of sulfamic acid were tested, 0, 5, and 10 g/l. The strip time was extremely fast, less than 30 seconds, but there was much gassing and fuming. The appearance was very poor with black spots and stains, and incomplete removal. There was no water beading.

EXAMPLE XVI

The basic formula was used, using ethylenediamine hydrochloride as the amine salt. Two levels of 70% nitric acid were used, 200 g/l and 500 g/l. Stripping rate was very fast but the appearance was not very satisfactory.

EXAMPLE XVII

The basic formula was used, using ethylenediamine hydrochloride as the amine salt. Two levels of 70% methylsulfonic acid were used, 2.5 g/l and 75 g/l. Stripping rate was very fast and the appearance was excellent on all panels. A total of 20 test panels were run in each solution. The appearance at the end of the 20 panels was slightly better for the 75 g/l of methylsulfonic acid solution.

EXAMPLE XVIII

The basic formula was used, using ethylenediamine hydrochloride as the amine salt. Two levels of 45% ferric nitrate were used, 20 g/l and 250 g/l. Stripping rate was 3–4 minutes for the 20 g/l ferric nitrate and very fast, 0.75–1.5 minutes for the 250 g/l ferric nitrate. The appearance was excellent on all panels. A total of 20 test panels were run in each solution. The appearance at the end of the 20 panels was slightly better for the 250 g/l of 45% ferric nitrate solution, though both solutions were commercially acceptable.

EXAMPLE XIX

A series of test panels were run in the basic formula, using 10, 50, 100, 300, and 400 mls/liter of 10% ethylenediamine hydrochloride solution. Copper etching was excessive with 10 g/l, and negligible with the rest. Solder stripping time was <0.5 minutes to 2.5 minutes for all panels. No appreciable difference in stripping time was seen for the 10, 50, and 100 g/l solutions. Stripping times slowed down slightly for the 300 and 400 g/l solutions. All panels gave commercially acceptable clean copper surfaces.

EXAMPLE XX

A series of test panels were run in the basic formula, using 50 g/l of an equimolar mixture of hydrochloric acid and glycine, alanine, or propylenediamine. Solder stripping time was satisfactory for all panels. All panels gave commercially acceptable clean copper surfaces.

We claim:

1. A metal dissolving liquid for stripping tin, solder and the underlying tin-copper alloy from the copper substrate of a printed circuit board, consisting essentially of an aqueous solution of about 20 to 50 weight percent of 70% nitric acid aqueous solution;

about 0.1 to 2.6 weight percent of a source of ferric ions selected from the group consisting of ferric nitrate, ferric chloride, ferric acetate, ferric lactate, ferric ammonium sulfate, ferric ammonium chloride, ferric citrate, ferric hydroxide, ferric oxide, and non-sulfur bearing water soluble ferric salts of organic and inorganic nature;

about 0.5 to 10 weight percent of a chloride ion source;

about 0.25 to 7.5 weight percent of a 70% methylsulfonic acid aqueous solution;

about 0.1 to 5 weight percent of a water soluble organic amine selected from the group consisting of ethylenediamine, diethylenetriamine, triethylenepentamine, monoethanolamine, diethanolamine, triethanolamine, 1, 1, 1", 1" tetrakishydroxyethylenediamine, 1,4-diazabicyclo[2.2.2} octane, hexamethylenetetramine, glycine, alanine, propanolamine, propylenediamine, and cyclohexylamine; and, about 0.03 to 2.5 weight percent of sulfamic acid.

2. A liquid as defined in claim 1 including a material selected from the group consisting of benzotriazole, tolytriazole and combinations thereof in an amount not more than about 5% by weight of the liquid.

3. A liquid as defined in claim 1 wherein the proportions of the aqueous solution are:

about 25 to 40 weight percent of 70% nitric acid aqueous solution, about 10 to 20 weight percent of 45% ferric nitrate aqueous solution, about 0.5 to 5 weight percent of a chloride ion source, about 1 to 5 weight percent of a 70% methylsulfonic acid aqueous solution, and about 0.25 to 5 weight percent of a water soluble organic amine.

4. A liquid as defined in claim 3 including about 0.1 to 2.5 weight percent of benzotriazole and about 0.1 to 2.5 weight percent of tolytriazole.

5. A liquid as defined in claim 1 wherein said source of chloride ions is selected from the group consisting of HCl, $NH_4Cl$, $FeCl_3$, water soluble amine chloride salts, and combinations thereof.

* * * * *